United States Patent [19]

Barrois et al.

[11] Patent Number: 4,892,301

[45] Date of Patent: Jan. 9, 1990

[54] SHEET FEEDER AND ACCELERATOR

[75] Inventors: Claus D. Barrois, Markthiedenfeld; Philipp A. Dieterich, Randersacker, both of Fed. Rep. of Germany

[73] Assignee: Koenig & Bauer Aktiengesellschaft, Würzburg, Fed. Rep. of Germany

[21] Appl. No.: 243,729

[22] Filed: Sep. 13, 1988

[30] Foreign Application Priority Data

Sep. 17, 1987 [DE] Fed. Rep. of Germany ..... 3731216

[51] Int. Cl.[4] ..... B65H 5/06

[52] U.S. Cl. ..... 271/227; 271/246; 271/258; 271/265; 271/274

[58] Field of Search ..... 271/227, 245, 246, 273, 271/274, 258, 265

[56] References Cited

U.S. PATENT DOCUMENTS

| | | | |
|---|---|---|---|
| 3,630,519 | 12/1971 | Spear | 271/246 |
| 4,702,470 | 10/1987 | Ishii | 271/246 X |
| 4,750,853 | 6/1988 | Van Soest | 271/246 X |

FOREIGN PATENT DOCUMENTS

3319753A1 1/1983 Fed. Rep. of Germany .

*Primary Examiner*—Richard A. Schacher

*Attorney, Agent, or Firm*—Jones, Tullar & Cooper

[57] ABSTRACT

A sheet feeder and accelerator for feeding of sheets, which have been aligned at front register lays, to a sheet-treating machine uses a driven accelerating roller and a plurality of cooperative pressure rollers. The time of contact between these rollers is varied by axially shifting of a control drum which has a control recess that is provided with an axially varying opening or switching angle.

5 Claims, 3 Drawing Sheets

SHEET FEEDER AND ACCELERATOR

FIELD OF THE INVENTION

The present invention is directed generally to a sheet feeder and accelerator. More particularly, the present invention is directed to a sheet feeder and accelerator for feeding sheets to a sheet-treating machine. Most specifically, the present invention is directed to a sheet feeder and accelerator having a sheet accelerating roller and a variable duration pressure roller. Sheets to be fed to the sheet-treating machine are brought into contact with the front sheet register lays and are held before being released to sheet grippers on an impression cylinder or the like. While being held, each sheet is tensioned or bulged by being forced into contact with an accelerating roller by a pressure roller. The contact time of this pressure roller with the sheet is controlled by a control drum which carries an axially extending, variable angle control recess. The rotating control drum is axially shiftable.

DESCRIPTION OF THE PRIOR ART

It is generally known in the art to feed sheets to various sheet-treating devices, such as impression cylinders or the like. This sheet feeding may be accomplished by passing the sheets along a sheet feed table that is provided with front register lays. Such front register lays are typically caused to periodically stop and then release sheets to the sheet-treating assembly in a properly timed or spaced sequence.

One such paper feed device is shown in German published, Non-Examiner Application DE-OS No. 3319753. This application discloses a conveyor belt which is used for bringing sheets up to parallel disposed, pivotable front lays and in this way aligning the sheet. This prior art paper feed device has a pivotable pressure roller which can be brought into contact with a driven conveyor roller in a timed manner. Control of the pressure roller and the front lays is accomplished by a cam positioned on the cylinder to which the sheet is to be fed, so that the control of the pressure roller and the front lays depends on the rotational speed of this sheet-treating cylinder. To adjust the operation of the pressure roller in relation to the opening and closing of a row of grippers on the sheet-treating cylinder, the length of contact time of the pressure roller with the conveyor roller can be varied. This contact time variation is accomplished in this prior device by means of the tension of a pressure spring and thus by effecting a change in this spring's characteristic or its spring force. The pressure spring is supported at one end against a lever which carries the pressure roller and at the other end against a control lever which can be brought into operational contact with the control cam. An increase in the contact time between the pressure roller and the conveyor roller, which is accomplished by an increase in the initial tension of the spring, results in the pressure roller being pressed against the conveyor roller sooner and being pulled off the pressure roller later. Accordingly, a sheet located between the pressure roller and the conveyor roller is accelerated sooner and longer. For this reason, the sheet to be fed to the sheet-treating cylinder encounters the paper stops of the sheet grippers of the cylinder sooner than it would had the length of contract time between the pressure roller and contact roller not been increased.

Sheet feeding and accelerating devices of the general type discussed above obtain a prolongation of the contact time between the pressure roller and the contact roller by starting the sheet acceleration at an earlier time. However this earlier contact between the sheet and the sheet stops results in a less desirable angular positioning of the sheet gripper pads on the sheet-treating cylinder in relation to the sheet. This means that the sheet being accelerated does not encounter the gripper pads tangentially in relation to the circumference of the sheettreating cylinder. This may well cause a permanent deformation of the leading edges of the sheets, with this deformation being particularly apparent on thin sheets. This front sheet deformation may lead to registration difficulties during later steps in the sheet printing.

It will be seen that a need exists for a sheet feeder and accelerator in which the leading edges of the sheets are uniformly brought into contact with front register lays and in which sheet tensioning or bulging can be controllably varied. The sheet feeder and accelerator of the present invention provides such a device.

SUMMARY OF THE INVENTION

It is an object of the present invention to provide a sheet feeder and accelerator;

Another object of the present invention is to provide a sheet feeder for feeding a sheet to an impression cylinder;

A further object of the present invention is to provide a sheet feeder in which the initial tension of the sheet can be set.

Yet another object of the present invention is to provide a sheet feeder to which the initial tension of the sheet can be selectively set without changing the arrival time of the sheet at the impression cylinder.

Still a further object of the present invention is to provide a sheet feeder for feeding sheets, aligned along front register lays, to a sheet-treating machine.

Even yet another object of the present invention is to provide a sheet feeder having an accelerating roller and a cooperating pressure roller whose time of contact is variable.

As will be discussed in greater detail in the description of the preferred embodiment which is set forth subsequently, the sheet feeder and accelerator in accordance with the present invention uses a sheet feed table to transfer sheets from a sheet conveyor to an impression cylinder provided with sheet grippers. A plurality of front register lays periodically reciprocate to stop and release the sheets. While a sheet is stopped, it is held between an acceleration roller and a pressure roller for an adjustable length of time. This imparts a variable initial tension or bulge to the sheet. The contact time between the sheet and the acceleration roller is variable by axial movement of a control drum which carries an axially varying control recess. A control roller rides on this control drum and brings the pressure roller into contact with the acceleration roller so long as the control roller is situated in the control recess on the control drum.

An advantage of the sheet feeder and accelerator or tensioning device of the present invention is that the sheet always contacts the sheet stops of the gripper row of the impression cylinder tangentially to the circumference of the impression cylinder. Additionally, the desired initial tensioning or bulging of the sheets can be set during feeding of the sheets. This proper setting of the sheet bulging assures a secure and correctly registered gripping of the sheet. It also reduces the noise generated by the sheet feeding and accelerating device. Adjustment of sheet feeding and acceleration or initial tensioning can be made while the printing press is in operation and thus down-time of the machine is avoided.

BRIEF DESCRIPTION OF THE DRAWINGS

While the novel features of the sheet feeder and accelerator in accordance with the present invention are presented with particularity in the appended claims, a full and complete understanding of the invention may be had by referring to the detailed description of the preferred embodiment which is set forth subsequently, and as is illustrated in the accompanying drawings, in which:

DESCRIPTION OF THE PREFERRED EMBODIMENT

Figure 1:
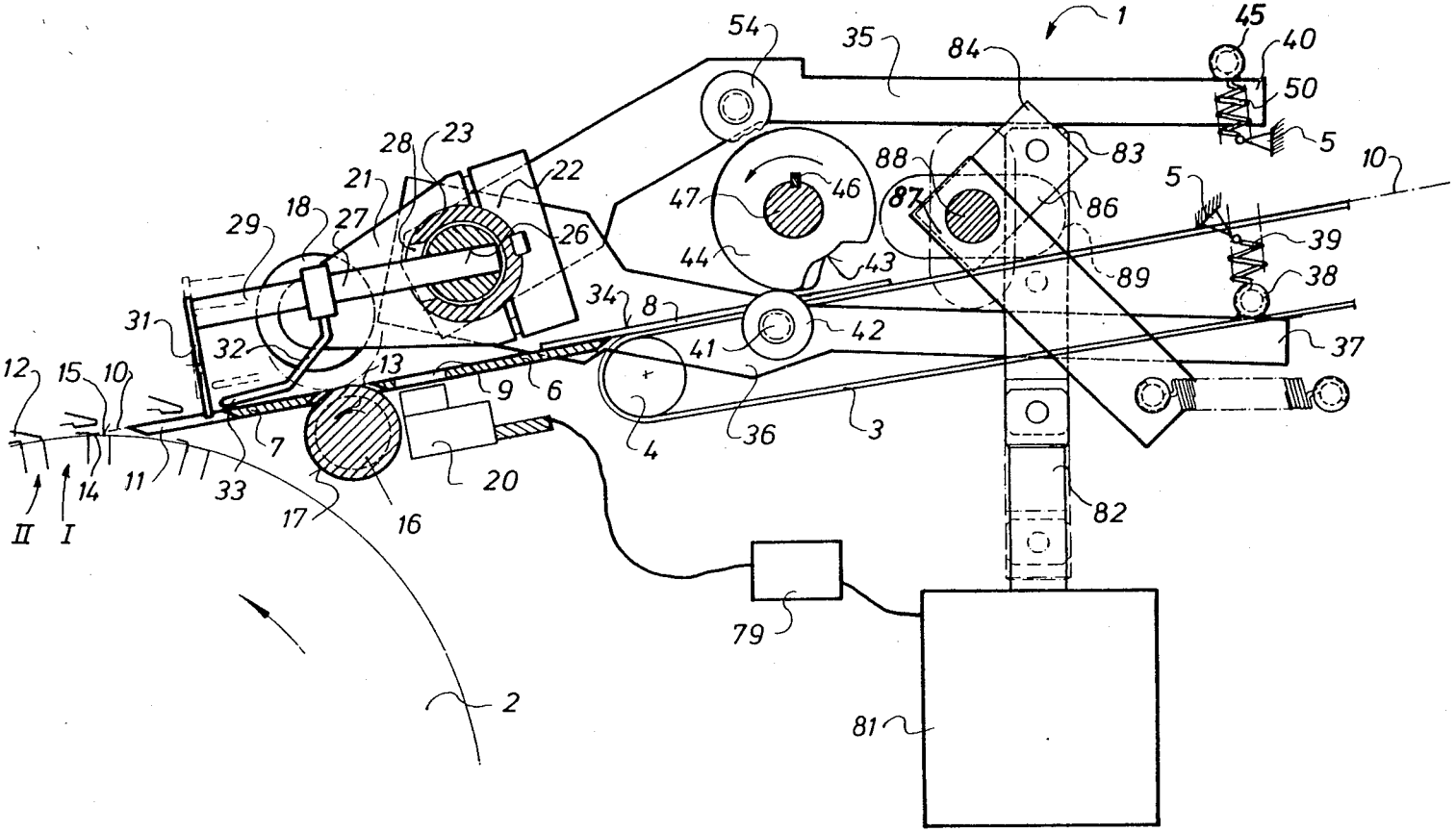
FIG. 1 is a side elevation view, partly in section, of a sheet feeder and accelerator in accordance with the present invention with portions of the side frames removed for clarity.

Referring initially to FIG. 1, there may be seen a sheet feeder and accelerator in accordance with the present invention generally at 1. The paper feed device 1 shown in FIG. 1 is disposed between an impression cylinder 2 and a conveyor belt 3. The conveyor belt 3 passes around a drive roller 4 and is driven by it. Drive roller 4 is rotatably supported in a generally conventional manner in side frames 5 of the sheet feed device 1. The drive roller 4 is driven in a generally known manner, which is not specifically described, by the main drive of the printing machine with a low gear ratio so that the feed speed of the conveyor belt 3 is slightly higher than the circumferential speed of the impression cylinder 2.

The paper or sheet feed device 1 has a two-part sheet guide plate 6 and 7 which is disposed in the extension of the plane 10 of conveyor 3. A sheet 8 is supported and guided by guide plate 6 and 7 and is conveyed to the impression cylinder 2. The first sheet guide plate 6 has a plurality of bores or apertures 9 disposed next to each other crosswise to the conveying direction. A photocell 20 is positioned beneath these bores or apertures 9 in the first sheet guide plate 6 and detects whether or not a stream of sheets 9 is interrupted.

The second sheet guide plate 7 is a comb plate and has a number of slots 11 which are disposed next to each other, and through which grippers 12, situated on the periphery of the impression cylinder 2, extend. These grippers 12 cooperate with gripper pads 15, which each have a sheet stop 14. In FIG. 1 these grippers 12 are depicted in two positions, I and II. Position I indicates the moment when the sheet 8 encounters the sheet stop 14 in a position nearly tangentially to the circumference of the impression cylinder 2. Position II indicated the closing of the grippers and the tangential removal of the sheet 8 from the conveyor plane 10 and from the surface of the first and second sheet guide plates 6 and 7.

Figure 2:
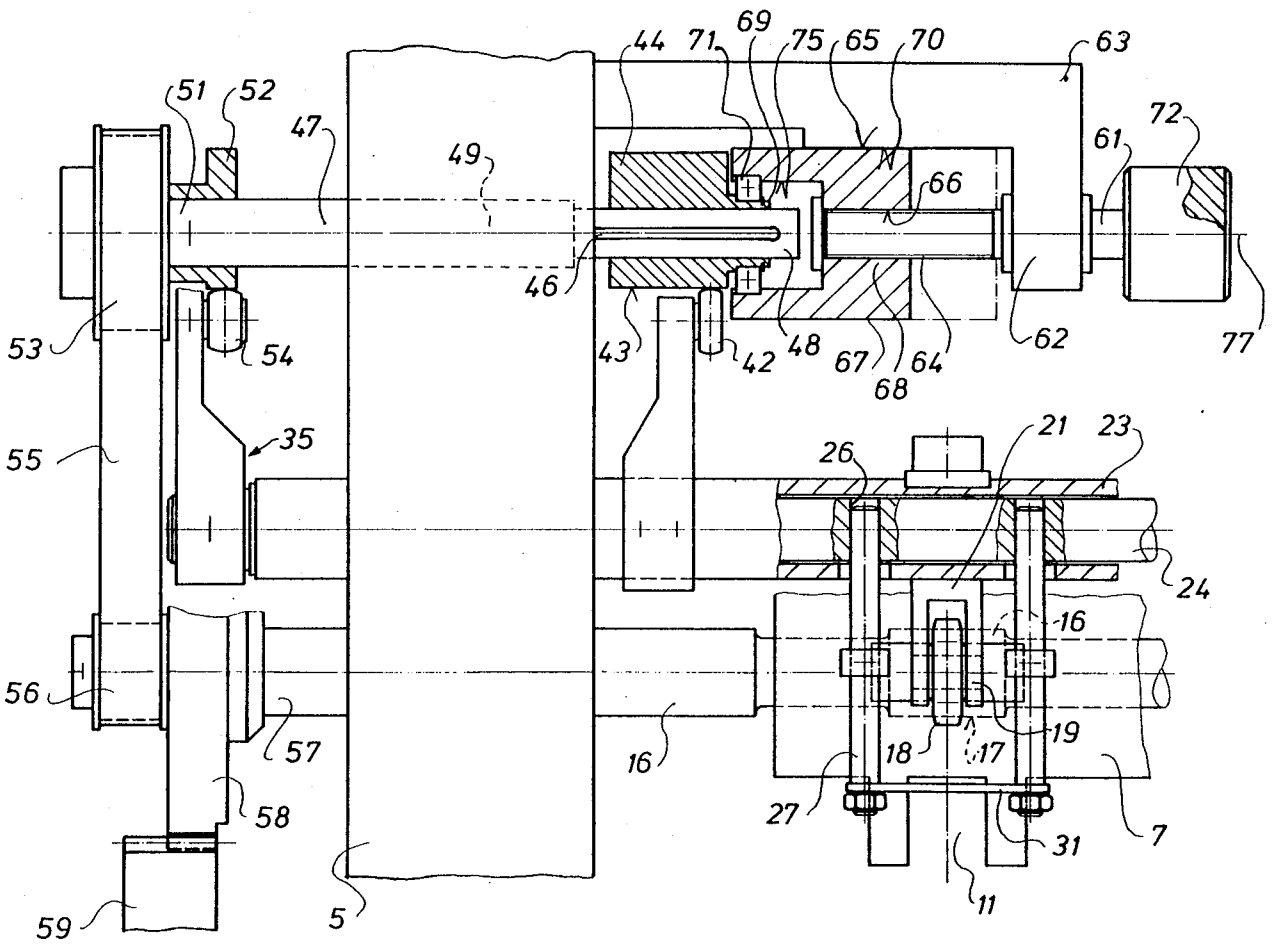
FIG. 2 is a top plan view of the sheet feeder and accelerator of FIG. 1.

As may be seen in FIGS. 1 and 2, an accelerating roller 16 is placed in a gap 13 between the first and second sheet guide plates 6 and 7, respectively. The surface or casing 17 of accelerating roller 16 extends slightly above the plane 10 of the surface of the sheet guide plates 6 and 7. Accelerating roller 16 is driven by the main drive of the printing machine in a generally conventional manner which is not specifically shown, with a low gear ratio so that the circumferential speed of accelerating roller 16 is somewhat higher than that of impression cylinder 2. In the preferred embodiment, the speed of accelerating roller 16 is generally about 1.27 times that of impression cylinder 2.

Above the accelerating roller 16 there are disposed a plurality of pivotable pressure rollers 18 which are positioned next to each other crosswise to the conveying direction of sheets 8. Each of the pressure rollers 18 is rotatably disposed at a first end 19 of a pressure roller lever 21. The pressure roller levers 21 have their second ends 22 secured to an outer tube 23 of a coaxial shaft. This outer tube 23 is rotatably supported on an inner rod 24 of the coaxial shaft. The inner rod 24 of the coaxial shaft is rotatably disposed in the side frame 5 of the paper feed device 1 and has a plurality of diametral bores 26 spaced at a distance in an axial direction of rod 24, thus being crosswise to the direction of the travel of sheets 8. Each diametral bore 26 carries a front register lay lever 27 which is securely positioned in its diametral bore 26. The outer tube 23 of the coaxial shaft has a corresponding number of slots 28 so that the front register lay levers 27 will extend freely pivotably through the slots 28. The lay levers 27 are disposed approximately parallel to the pressure roller levers 21 and have front lays 31 at their free ends 29. In a downwardly pivoted position, the front lays 31 extend slightly into the slots 11 of the comb plate 7. A sheet smoother 32 is disposed approximately at the midlength of each of the lay levers 27 and pressures on an upper side 34 of the sheet 8 with an end 33, which is curved in the conveying direction, when the front lays 31 are pivoted upwardly and away.

The outer tube 23 of the coaxial shaft assembly fixedly carries a pressure roller control arm 36 while the inner rod 24 of the coaxial shaft fixedly carries a front register lay control arm 35. These arms 35 and 36 are in addition to, or separate from the pressure roller levers 21 and the lay levers 37 and may be seen in FIGS. 1 and 2. Each of the arms 35 and 36 carry on their free ends 37 and 40, respectively supports 38 and 45 for tension springs 39 and 50. These tension springs 39 and 50 are fastened to the side frame 5 of the printing machine and provide restorative force.

Pressure roller control arm 36 carries a pressure arm control roller 42 which is rotatably attached to control arm 36 by a suitable bolt 41 or the like. Because of the upward force of the tension spring 39, the pressure arm control roller 42 is in constant contact with a surface portion area 43 of a control drum 44, which is seen most clearly in FIG. 3. Secured by a key 46, the control drum 44 is axially slidably carried on a right end 48 of a fixed speed rotating shaft 47, as seen in FIG. 2, so that the control roller 42 can be brought into contact with all surface ares 43 of the control drum 44. It would alternatively also be possible to have the control roller 42 be axially slideable in order to bring it into contact with all surface areas 43 of the control drum 44.

The fixed speed rotating shaft 47 is rotatably positioned with its center 49 in the side frame 5 of the drive side. A left end 51 of the fixed speed rotating shaft 47 supports a control cam 52, which is fixed against rotation and displacement, and which is in constant contact with a lay arm control roller 54. The lay arm control roller 54 is rotatably attached to the front register lay control arm 35 and controls the movement of the front lays 31. Also disposed on the left end 51 of the fixed rotational speed shaft 47, and immediately adjacent to the control cam 52, is a drive wheel 53 which is connected by means of a belt 55 with a drive pinion 56. The drive pinion 56, together with a shaft 57 for the accelerating roller 16, are driven by the main drive 59 of the printing machine by a gear wheel 58.

Control drum 44 is axially slidably supported on the fixed rotational speed shaft 47 by an adjusting spindle assembly 61 which is shown most clearly in FIG. 2. The adjusting spindle 61 is rotatably supported in a transverse leg 62 of a horizontal tie bar 63 which is bolted to the side frame 5. The adjusting spindle 61 has a threaded shank 64 which is in threaded contact with a threaded bore 66 of a block-shaped adjusting element 67. The threaded bore 66 is disposed exactly in the center of a base 68 of the adjusting element 67. An upper surface 65 of the adjusting element 67 slideably abuts against a bottom surface 70 of the tie bar 63 and has a horizontal countersunk bore 75 which coaxially surrounds a reduced diameter hub 69 of the control drum 44. A rolling bearing 71, which is also capable of absorbing axial forces, provides the connection between the adjusting element 67 and the control drum 44. The adjusting spindle 61 has a knurled head 72 which eases manual operation of the adjusting spindle 61. It is, of course, possible to connect the adjusting spindle 61 with the shaft of an adjusting motor so that remote adjustment is possible. Thus as the knurled head 72 is rotated, the adjusting element 67 is caused to move to the right or left, as viewed in FIG. 2. This movement, in turn, shifts control drum 43 to the right or left on the end 48 of the fixed rotational speed shaft 47. Since pressure roller arm control roller 42 is not axially shiftable, the control drum 43 is also movable axially with respect to it.

Figure 3:
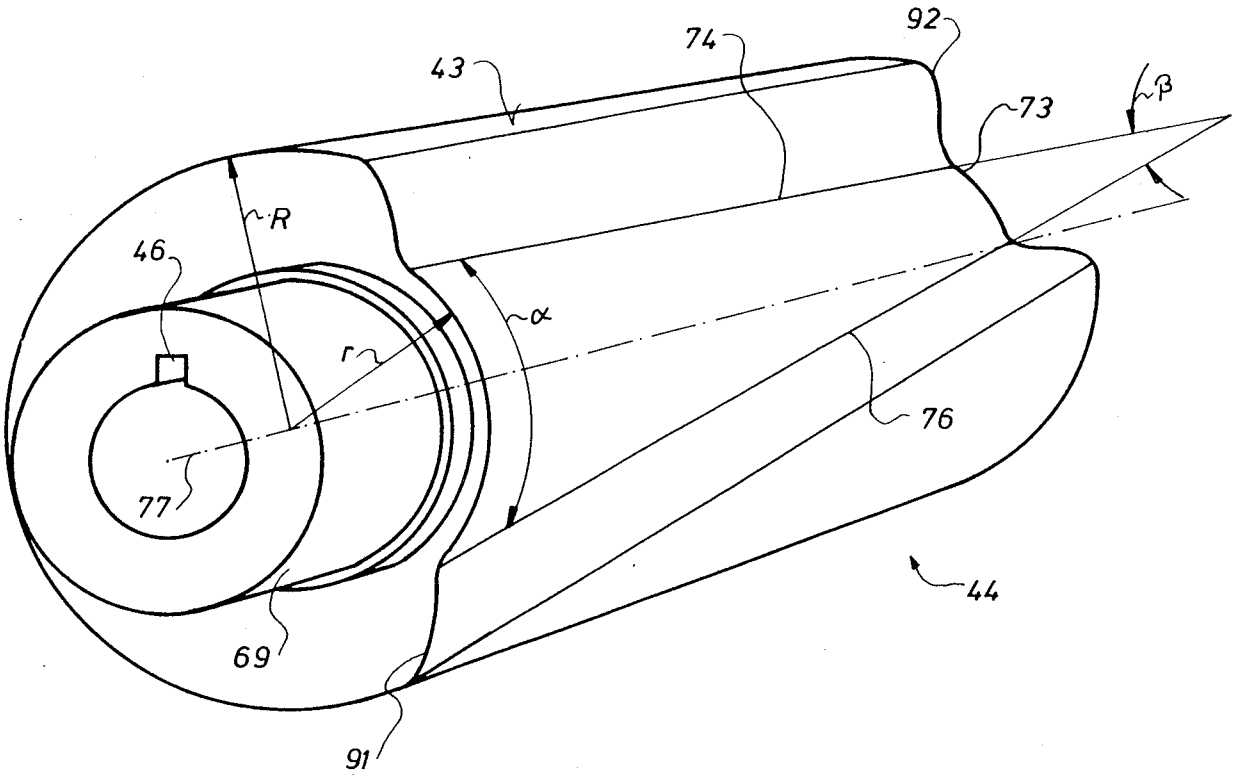
FIG. 3 is a perspective view of a control drum in accordance with the present invention.

As may be seen most clearly in FIG. 3, the control drum 44 is a cylindrical body with a radius R and has at its circumference a control recess 73 with a reduced radius r. The recess 73 extends the length of the control drum 44 and has an opening or switching angle $\alpha$ which progressively changes along the length of a rotational axis 77 of the control drum 44. It is also possible to compose the control drum 44 of a plurality of control disks.

The control roller 42 of the pressure roller control arm 36 traverses across the control recess 73 in control drum during each revolution of the fixed rotational speed shaft 47 and thus rolls along the portion of the drum surface 43 having the smaller radius r. The control recess 73 has a first control line 74, which is parallel to axis 77, as well as a second control line 76, which is not parallel, but which is disposed in relation to the rotational axis 77 with a constant radius r. The control lines 74 and 76 define the position of the pressure rollers 18 in relation to the accelerating roller 16. When the pressure roller arm control roller 42 crosses the first control line 74, the pressure rollers 18 are pressed against the accelerating rollers 16 to place the sheet feeder in an "acceleration on" mode. When the control roller 42 crosses the second control line 76, the pressure rollers 18 are lifted off the accelerating rollers 16 to place the sheet feeding in an "acceleration off" mode. The control lines 74 and 76, or their extensions, intersect at an acute angle $\beta$ for example of about 20°.

As shown in FIG. 3, the opening or switching angle $\alpha$ of the recess 73 in the control drum 44 is greater at a front edge 91 of the control drum 44 than at a rear edge 92. The control drum 44 is curved in all surface areas 43, so that contact of the control roller 42 with the control drum 44 is assured during a complete revolution of the fixed rotational speed shaft 47 and shocks, which would arise because of the lifting and return of the control roller 42 at sharp edges, are avoided.

As was discussed previously, a photocell 20 is placed beneath each of a plurality of adjacent apertures 9 in the first sheet guide plate 6. The photocell 20 is connected to an electromagnet 81 by a switching relay 79. The electromagnet 81 has a switch rod 82 which, depending on the position of the armature of the electromagnet 81, will be pushed out or in, and which is articulated to an upper portion 83 of a first end 84 of a connecting rod 86. The connecting rod 86 is securely connected at a second end 87 to an adjusting shaft 88 that is disposed in the side frame 5. Two blocking cams 89 are fixed at a distance on the adjusting shaft 88. The blocking cams 89 each interact directly with the control arm 36 for the pressure rollers 18 or the control arm 35 for the front lays 31 and stop the pivoting movement of the control arms 36 and 35 if the photocell 20 signals an interruption in the flow of the sheets.

When it is desired to change the tension or bulging imparted to the sheet 8, and to thus vary its prestressing which occurs after encountering the gripper stops 14 and before the grippers 12 close, as may be the case, for example, when the type or thickness of the paper is changed, the adjusting spindle 61 is turned clockwise or counterclockwise. Turning the adjusting spindle 61 clockwise, for example, causes shifting of the adjusting element 67 to the right, and results in a corresponding displacement to the right of the control drum 44. Because of this, the pressure roller arm control roller 42 progressively comes into contact with a different surface areas 43 of the control drum 44. Due to the increasing opening or switching angle $\alpha$, which may vary from 30°–100°; on the surface portion 43 of control drum 44 in the vicinity of the front edge 91, the control roller 42 remains in contact with the small radius r portion of the control drum 44. This results in a correspondingly longer contact between the pressure roller 18 and the accelerating roller 16. It will again be noted that the first central line 74 on control drum 44 is parallel to the axis of rotation 77 of the control drum 44. This means that the beginning of the acceleration of a sheet 8 remains constant and only the end of acceleration and thus the total acceleration time changes. Thus it will be seen that axial shifting of control drum 44 varies the duration of the time of contact between the pressure rollers 18 and the accelerating roller 16. While the start of contact does not vary with axial movement of control drum 44, the duration does. By using the sheet feeding and accelerating assembly of the present invention, the initial tension imparted to the sheets may be varied without adversely affecting the gripping of the sheets by the sheet grippers.

While a preferred embodiment of a sheet gripper and accelerator in accordance with the present invention has been set forth fully and completely hereinabove, it will be apparent to one of skill in the art that a number of change in, for example the particular structure of the sheet grippers, the type of conveyor belt, the number of pressure rollers and the like could be made without departing from the true sprit and scope of the subject invention which is accordingly to be limited only by the following claims.

What is claimed is

1. A sheet feeding and accelerating assembly for feeding sheets aligned by front register lays to a sheet-treating machine and for selectively controlling an initial tension applied to the sheets, said sheet feeding and accelerating assembly comprising:

means to forward said sheets to the sheet-treating machine;

a driven accelerating roller and at least one cooperating pressure roller for periodically contacting said sheets on said means to forward said sheets; and means for adjustably controlling the time of contact of said at least one pressure roller with said accelerating roller, including a drivable control drum on which a control roller for said at least one pressure roller runs, said control drum having an axially extending control recess whose opening angle varies axially and wherein said control roller and said control drum are shiftable axially with respect to each other.

2. The sheet feeding and accelerating assembly of claim 1 wherein said control drum has a first control line which is parallel to the axis of rotation of said control drum, and a second control line which is not parallel to but which is disposed at a fixed distance to said axis of rotation of said control drum, said first and second control lines intersecting each other at an acute angle.

3. The sheet feeding and accelerating assembly of claim 1 wherein said control drum is axially shiftable.

4. The sheet feeding and accelerating assembly of claim 3 further including means to shift said control drum axially.

5. The sheet feeding and accelerating assembly of claim 1 further including means to detect the absence of sheets on said said sheet forwarding means and means to prevent said at least one pressure roller from contacting said accelerating roller during said absence of said sheets.

* * * * *